US005945914A

United States Patent [19]

Holmes et al.

[11] Patent Number: 5,945,914

[45] Date of Patent: Aug. 31, 1999

[54] TOILET SEAT OCCUPANCY MONITORING APPARATUS

[75] Inventors: Fred H. Holmes, Cleveland; Sanford G. Fitzgerald, Tulsa, both of Okla.

[73] Assignee: Bed-Check Corporation, Tulsa, Okla.

[21] Appl. No.: 09/096,404

[22] Filed: Jun. 11, 1998

[51] Int. Cl.[6] ..... G08B 21/00

[52] U.S. Cl. ..... 340/667; 200/85 A; 340/573.4

[58] Field of Search ..... 340/666, 667, 340/573.1, 573.4, 573.7; 200/85 R, 85 A

[56] References Cited

U.S. PATENT DOCUMENTS

| | | | |
|---|---|---|---|
| D. 361,462 | 8/1995 | Newham | D6/567 |
| 3,812,313 | 5/1974 | Wolf et al. | 200/86 R |
| 3,866,335 | 2/1975 | Neville | 34/602 |
| 4,154,178 | 5/1979 | Brown et al. | 112/457 |
| 4,179,692 | 12/1979 | Vance | 340/573.1 |
| 4,295,133 | 10/1981 | Vance | 340/573.4 |
| 4,484,043 | 11/1984 | Musick et al. | 200/85 R |
| 4,539,445 | 9/1985 | Jabben | 200/5 A |
| 4,565,910 | 1/1986 | Musick et al. | 200/85 R |
| 4,621,178 | 11/1986 | Taguchi et al. | 210/685 |
| 4,675,659 | 6/1987 | Jenkins, Jr. et al. | 340/573.1 |
| 4,700,180 | 10/1987 | Vance | 340/573.4 |
| 4,773,115 | 9/1988 | Smith | 15/104.12 |
| 5,047,602 | 9/1991 | Lipka | 200/86 R |
| 5,479,939 | 1/1996 | Ogino | 340/575 X |
| 5,554,835 | 9/1996 | Newham | 200/85 R |
| 5,600,108 | 2/1997 | Newham | 200/50.28 |
| 5,623,760 | 4/1997 | Newham | 29/622 |
| 5,625,294 | 4/1997 | Kawai et al. | 340/562 X |
| 5,633,627 | 5/1997 | Newham | 340/573.4 |
| 5,640,145 | 6/1997 | Newham | 340/573.1 |
| 5,654,694 | 8/1997 | Newham | 340/573.1 |
| 5,748,096 | 5/1998 | Kaufer | 340/686.1 |

*Primary Examiner*—Thomas Mullen
*Attorney, Agent, or Firm*—Fellers, Snider, Blankenship, Bailey & Tippens, P.C.

[57] ABSTRACT

The present invention relates generally to an apparatus for monitoring the occupancy status of a toilet seat. In more particular, it applies to a pressure sensitive switch that can be used in combination with an electronic monitoring device to notify a nearby care-giver or a remote nurse's station that a patient has raised himself or herself from the toilet. Broadly speaking, the instant device is composed of two elements—a pressure sensitive switch and an actuator—that are installed between the toilet seat and the upper rim of the toilet bowl. Pressure on the toilet seat is communicated via the actuator to the pressure sensitive switch which, when compressed, completes an electrical circuit. When the pressure is removed, the electrical circuit is broken, thereby signaling that the patient has risen from his or her seated position on the toilet.

14 Claims, 3 Drawing Sheets

TOILET SEAT OCCUPANCY MONITORING APPARATUS

FIELD OF THE INVENTION

The present invention relates generally to a device for monitoring the occupancy status of a toilet seat. In more particular, it applies to a pressure sensitive switch and actuator that are fitted to a conventional toilet and is used in combination with an electronic monitoring device to signal that a patient has raised himself or herself from the toilet seat.

BACKGROUND

It is well documented that the elderly and post-surgical patients are at a heightened risk of falling. There are many reasons for this but, broadly speaking, these individuals are often afflicted by gait and balance disorders, weakness, dizziness, confusion, visual impairment, and postural hypotension (i.e., a sudden drop in blood pressure that causes dizziness and fainting), all of which are recognized as potential contributors to a fall. Additionally, cognitive and functional impairment, and sedating and psychoactive medications are also well recognized risk factors.

A fall places the patient at risk of various injuries including sprains, fractures, and broken bones—injuries which in some cases can be severe enough to eventually lead to a fatality. Of course, those most susceptible to falls are often those in the poorest general health and least likely to recover quickly from their injuries. In addition to the obvious physiological consequences of fall-related injuries, there are also a variety of adverse economic and legal consequences that include the actual cost of treating the victim and, in some cases, caretaker liability issues.

In the past, it has been commonplace to treat patients that are prone to falling by limiting their mobility through the use of restraints, the underlying theory being that if the patient is not free to move about, he or she will not be as likely to fall. However, research has shown that restraint-based patient treatment strategies are often more harmful than beneficial and should generally be avoided—the emphasis today being on the promotion of mobility rather than immobility. Among the more successful mobility-based strategies for fall prevention include interventions to improve patient strength and functional status, reduction of environmental hazards, and staff identification and monitoring of high-risk hospital patients and nursing home residents.

Of course, monitoring high-risk patients, as effective as that care strategy might appear to be in theory, suffers from the obvious practical disadvantage of requiring additional staff if the monitoring is to be in the form of direct observation. Thus, the trend in patient monitoring has been toward the use of electrical devices to signal changes in a patient's circumstance to a care-giver who might be located either nearby or remotely at a central monitoring facility, such as a nurse's station. The obvious advantage of an electronic monitoring arrangement is that it frees the care-giver to pursue other tasks away from the patient. Additionally, when the monitoring is done at a central facility a single nurse can monitor multiple patients which can result in decreased staffing requirements.

Generally speaking, electronic monitors work by first sensing an initial status of a patient, and then generating a signal when that status changes, e.g., he or she has sat up in bed, left the bed, risen from a chair, etc., any of which situations could pose a potential cause for concern in the case of an at-risk patient. Electronic bed and chair monitors typically use a pressure sensitive switch in combination with a separate monitor/microprocessor. In a common arrangement, a patient's weight resting on a pressure sensitive mat completes an electrical circuit, thereby signaling the presence of the patient to the microprocessor. When the weight is removed from the pressure sensitive switch, the electrical circuit is interrupted, which fact is sensed by the microprocessor. The software logic that drives the monitor is typically programmed to respond to the now-opened circuit by triggering some sort of alarm—either electronically (e.g., to the nursing station via a conventional nurse call system) or audibly (via a built-in siren). Some examples of devices that operate in this general fashion may be found in U.S. Pat. Nos. 4,484,043, 4,565,910, 5,554,835, and 5,634,760, the disclosures of which are incorporated herein by reference.

Seated at-risk patients pose a special challenge to electronic monitoring devices because they can rapidly rise to their feet, thereby quickly placing themselves in jeopardy. Since the seated patient is already postured to stand up, only a moment may be needed for a patient to rise to his or her feet and begin moving away from the chair. This situation is unlike that of the reclining patient who may first sit up and move to the edge of the bed, thereby making it easier for the staff to "catch" him or her before the bed is exited. Devices have been developed specifically for the purpose of monitoring the seated patient including, for example, the invention taught by U.S. Pat. No. 5,654,694, a battery powered unit that is designed for use on wheelchairs and cardiac chairs, the disclosure of which is incorporated herein by reference.

Of particular interest for purposes of the instant invention are those situations where the seated patient has been placed on the toilet and momentarily left unattended. Although this situation has a risk profile that is similar in many ways to that of seated wheelchair patient, the toilet presents certain unique design challenges that necessitate a different approach.

First, conventional chair occupancy monitors work by placing a pressure sensitive switch under the buttocks of the seated patient. Although this switch might take many forms, a popular arrangement is to seal together two broad bands of non-conductive material such as plastic, the inner surfaces of which have been made electrically conductive. The two plastic bands are separated by a non-conductive spacer that contains apertures therethrough which allow the conductive surfaces to come into contact if weight is placed on the unit. The patient's weight bearing down on the switch forces the two conducting faces together, thereby completing a circuit. Conversely, when the weight is lifted—i.e., when the patient leaves the monitored chair—the circuit is broken and a separate monitoring unit senses that fact and generates the appropriate alarm. Needless to say, it would just not be practical to use a chair monitor of this sort in a toilet setting, as it would be expected to interfere with the normal operation and use of the toilet.

Another design consideration in toilet seat monitors relates to the almost continuous presence of moisture around the unit. That is, it is well known to those skilled in the art that electronics and electrical equipment tend to deteriorate rapidly in the presence of moisture unless preventive steps are taken. However, a pressure switch-type monitor must necessarily be installed on or near the toilet bowl which potentially exposes it to raised atmospheric humidity levels, splashes, and other accidents that can soak the device. Finally, a monitor that is located proximate to the toilet must be made resistant to corrosive effects of common disinfectants and cleaners.

Thus, what is needed is a device that can detect a patient's presence or absence on a toilet seat and signal that condition to an electronic monitor. Additionally, this device should not interfere with the normal operation and/or use of the toilet. Finally, the device should be designed to be relatively unaffected by moisture and resistant to exposure to common cleaners and disinfectants.

Before proceeding to a description of the instant invention, however, it should be noted and remembered that the description of the invention which follows, together with the accompanying drawings, should not be construed as limiting the invention to the examples (or preferred embodiments) shown and described. This is so because those skilled in the art to which the invention pertains will be able to devise other forms of this invention within the ambit of the appended claims.

SUMMARY OF THE INVENTION

The invention disclosed herein pertains generally to an apparatus for monitoring the presence or absence of a patient sitting on a toilet or similar device. In more particular, it applies to a pressure sensitive switch that can be used in combination with an electronic monitoring device to notify a nearby care-giver or a remote nurse's station that a patient has raised himself or herself from the toilet.

According to a preferred aspect of the present invention, there is provided a device adapted for use on a conventional toilet seat for sensing the presence or absence of a weight such as a person resting thereon. In broadest terms, the device is a pressure sensitive switch/actuator combination which is fitted between the underside of the toilet seat and the upper toilet bowl surface.

The pressure sensitive switch consists generally of a body and an electrical connection thereto. The body is preferably formed in the shape of a roughly rectangular wafer and is a "sandwich" that is composed of three layers: an upper conducting layer, a lower conducting layer, and a central non-conducting spacer occupying the space between the two conducting layers. The outer layers are composed of a thin somewhat flexible material that conducts electricity on at least a portion of its inner surface (i.e., the surface in contact with the non-conducting spacer), a preferred material for the outer layers being some form of conductive polyester film, such as that which is obtained by vacuum coating conventional polyester film with aluminum.

The central non-conducting layer is preferably composed of a thin closed-cell polyurethane foam and contains at least one aperture therethrough. The hole is preferably round and of dimensions that are commensurate with the size of the contact surface of the actuator, discussed hereinafter.

The electrical connection to the body consists of a wire containing at least two isolated electrical leads and an electrical connector attached to one wire terminus. At the body end of the electrical wire, each of the two electrical leads is in communication with a different conductive surface. At the other end, the electrical leads terminate in the electrical connector, the connector providing a means for a monitoring unit to sense the status of the electrical connection between the conducting layers. The two electrical leads are kept electrically isolated from each other throughout their lengths.

The actuator is preferably made of an elastic material such as a rubber, although other materials could also be used. It should be formed with a contact area that is somewhat smaller than the aperture of the central spacing layer, with the preferred contact surface of the actuator being a blunt shape such as a hemispherical dome. The contact surface is so-called because it is the portion of the actuator that actually comes into contact with the pressure sensitive switch.

The function of the aperture in the central non-conducting layer is to allow the two conductive layers to be brought into contact with each other when sufficient weight is brought to bear on the body of the device via the actuator. Thus, in the preferred arrangement, the actuator will be affixed to the underside of the toilet seat in a position that just brings it into contact with the body of the instant device when the seat is lowered. When there is no weight resting on the seat, the tautness of the upper conductive layer—coupled with the elasticity of the central non-conductive layer—operates to keep the two conductive layers apart and, hence, out of electrical contact. Those skilled in the art will recognize that by varying the thickness and composition of the upper and lower conductive layers, the central spacer, and the actuator, the unit can be made more or less responsive to weight that is placed on the toilet seat.

In operation, when sufficient weight is brought to bear on the seat of the toilet, at least a portion of that weight will be transferred through the seat and into the actuator. The downward pressure on the actuator is then transferred to the upper conductive layer and the spacer. This results in a compression of the spacer and the forcing of the upper conductive layer downward through an aperture in the spacer and into contact with the lower conducting unit. When the weight is removed, the process is reversed. The natural elasticity of the upper conductive unit, combined with the rebound of the central non-conducting spacer, will cause it to separate from the lower conductive unit.

A remote monitoring unit, which is designed to accommodate the connector at the end of the electrical wire, detects and responds to the bringing together of the two conductive layers. When these layers are brought into contact, the monitoring unit will sense that the resistance between the two electrical leads has dropped to near zero. In the preferred embodiment, this condition activates or arms the attached monitor. As long as the measured resistance across the monitoring leads remains low, that is an indication that weight is still present on the toilet seat and, hence, the patient is still sitting thereon. However, if the resistance between the two monitoring leads increases to some predetermined level, that condition would normally indicate that the weight has been removed from the toilet seat and that the patient has likely stood. Upon sensing the high resistance condition, the monitoring unit will respond as it has been programmed to do and will generate an electrical, audible, or other alarm to notify the appropriate party of this changed circumstance.

Finally, in broadest terms the instant invention concerns the use of a binary switch together with an actuator to sense the presence of an individual on a toilet seat, a binary switch being one that is capable of sensing at least two conditions and responding to same via distinct electronic signals. Although a pressure sensitive switch is the binary switch of choice for use in the preferred embodiment, other types of switches could work as well.

The foregoing has outlined in broad terms the more important features of the invention disclosed herein so that the detailed description that follows may be more clearly understood, and so that the contribution of the instant inventor to the art may be better appreciated. The instant invention is not to be limited in its application to the details of the construction and to the arrangements of the components set forth in the following description or illustrated in the drawings. Rather, the invention is capable of other embodiments and of being practiced and carried out in various other ways not specifically enumerated herein. Finally, it should be understood that the phraseology and terminology employed herein are for the purpose of description and should not be regarded as limiting, unless the specification specifically so limits the invention.

DETAILED DESCRIPTION OF THE PREFERRED EMBODIMENTS

Figure 1:
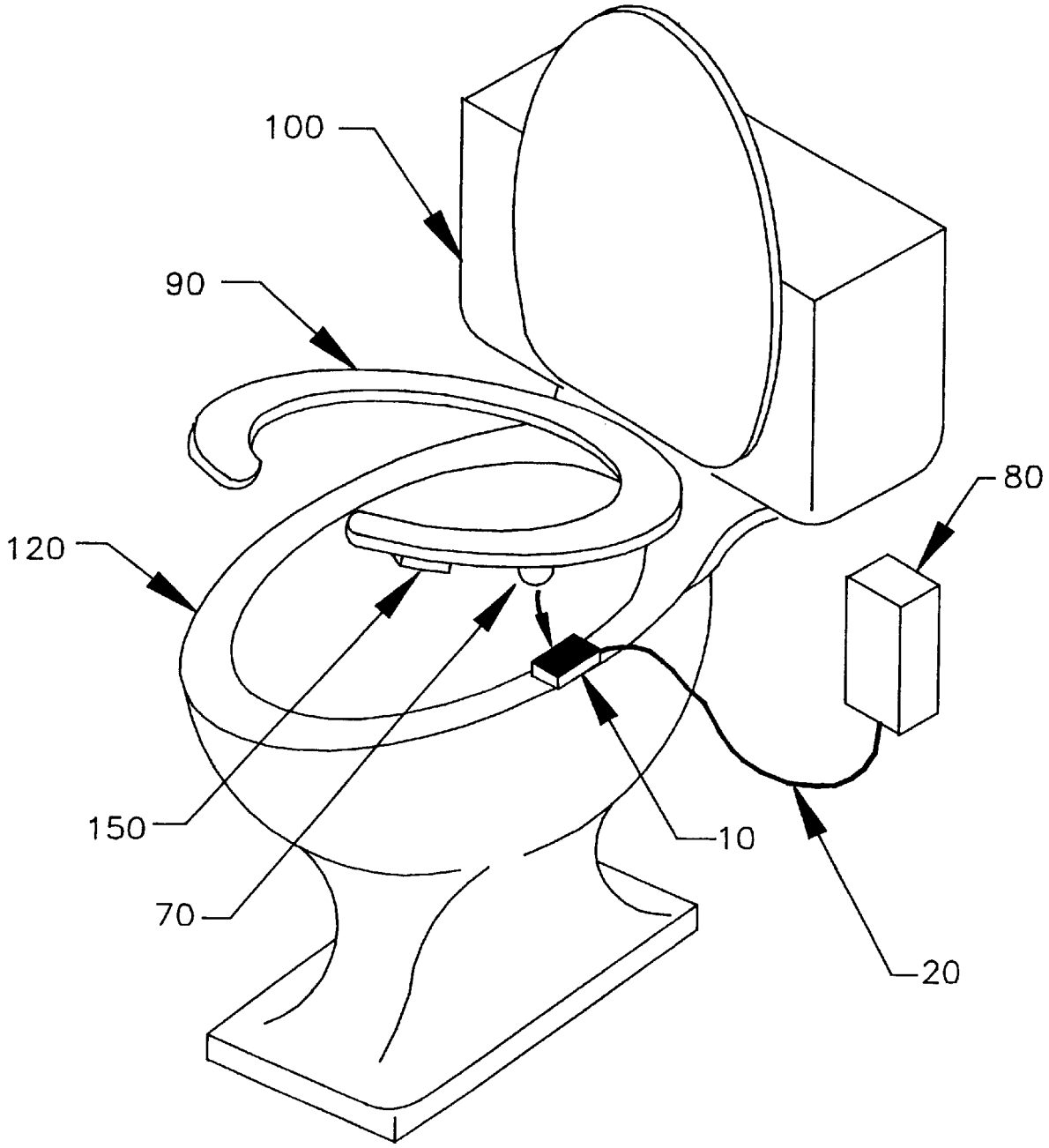
FIG. 1 is a schematic illustration that shows the general environment in which the instant invention would be used.

Referring to the drawings in detail, wherein like numerals denote identical elements throughout the several views, there is shown in FIG. 1 a schematic drawing that illustrates the general environment in which the instant invention would preferably be used. In more particular, in the preferred embodiment the body 10 of the instant device is installed on a toilet 100 between the toilet seat 90 and the upper rim 120 of the toilet bowl. This arrangement is not strictly required, and the instant inventors have specifically contemplated that the body 10 could, for example, alternatively be affixed to the underside of the toilet seat 90. However, it is advantageous to have the body 10 affixed to an immovable object since a trailing electrical wire 20 is attached thereto, the opposite end of which terminates within an electronic monitor 80. That being said, the design parameters of each particular application will dictate the best installation location for the body 10.

Figure 2B:
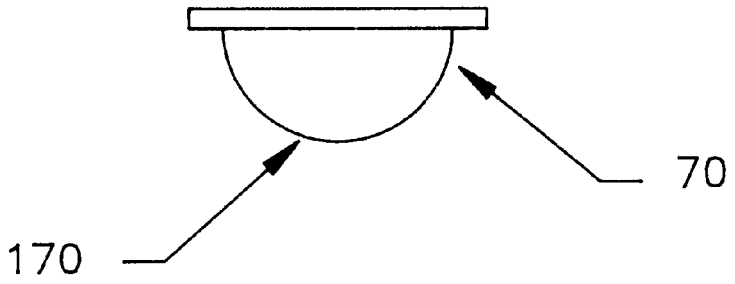
FIGS. 2A and 2B contain representations of the pressure sensitive switch and the actuator, respectively.
Figure 2A:
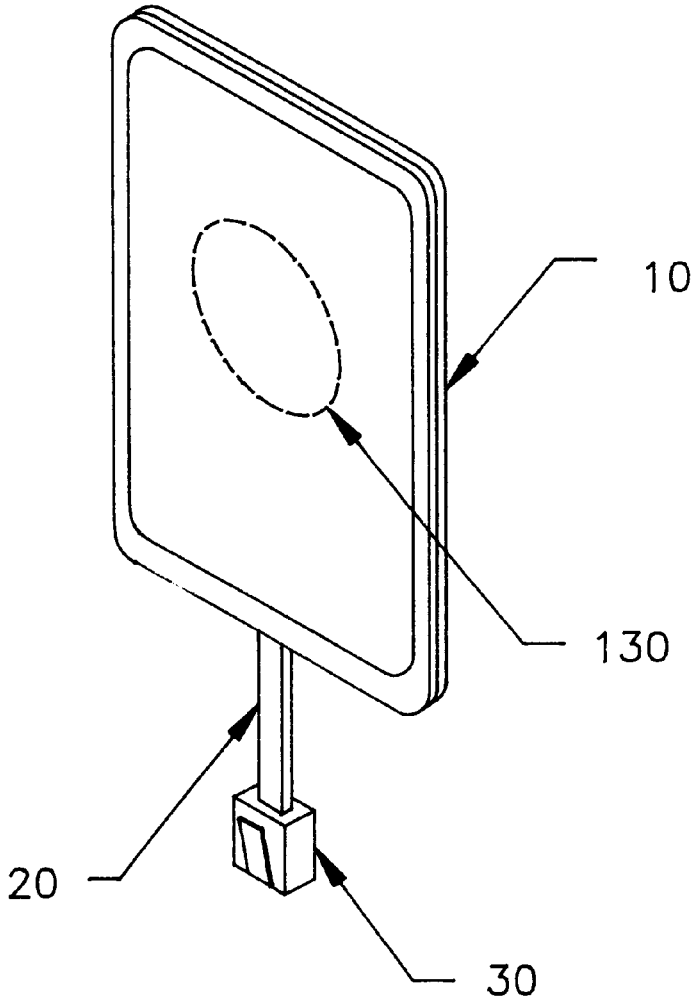
Figure 3:
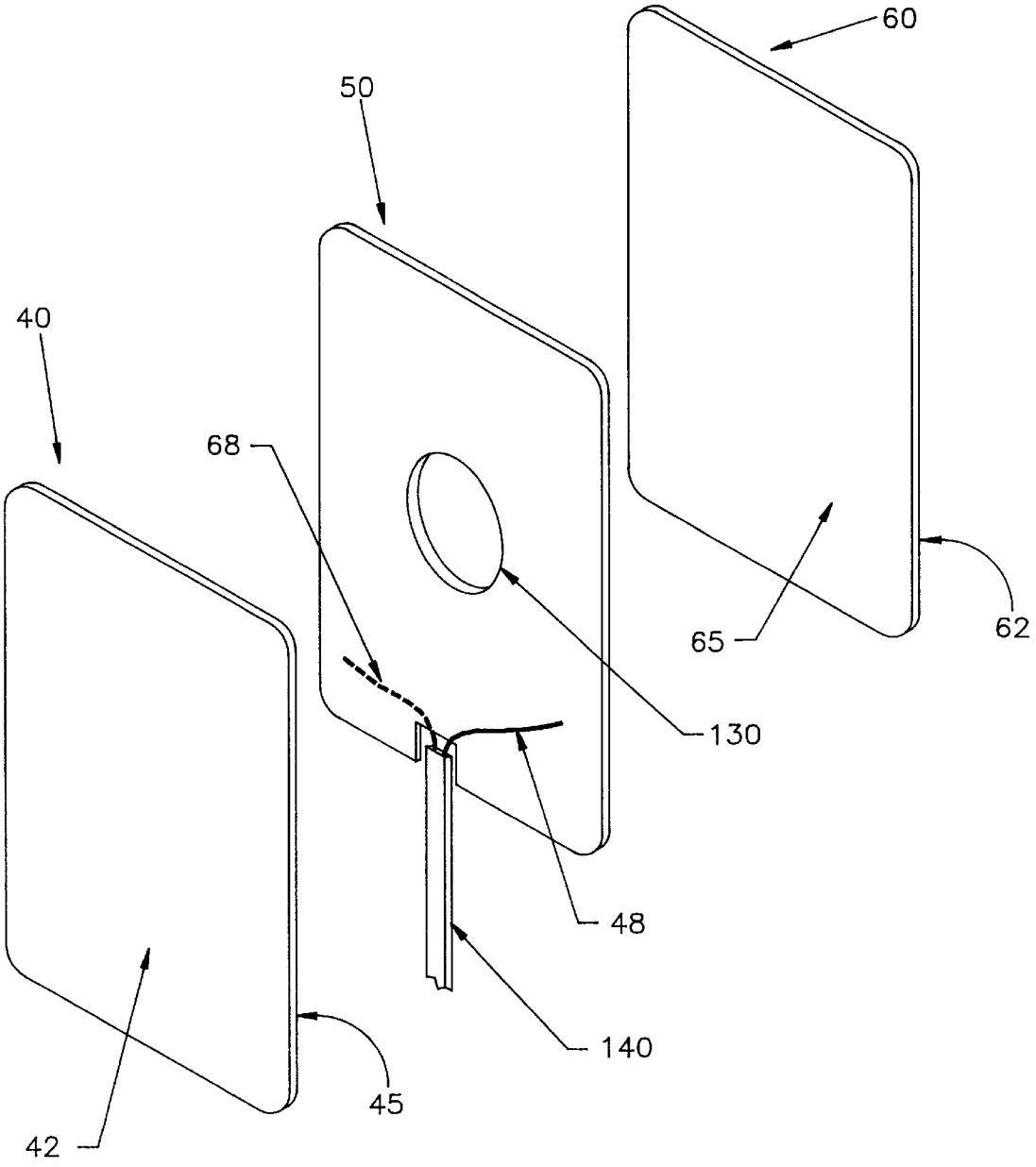
FIG. 3 contains an exploded view of the body of the pressure sensitive switch.

Turning now to FIG. 2A wherein the instant invention is shown in greater detail, the main components of the device are a pressure-type switch (i.e., the body 10), a bi-element electrical wire 20 and a connector 30. One end of the electrical wire 20 terminates within the body 10 of the unit and the other end terminates within connector 30. The connector 30 is preferably a standard electrical part such as an "RJ" type connector. The choice of a standard connector will make it easier to interface the device with an electronic monitor 80. As is best illustrated in FIG. 3, the electrical wire 20 must contain at least two electrically isolated conducting leads 48 and 68. Electrical lead 48 is in electrical contact with lower conductive layer 40 and the other lead 68 is in electrical contact with upper conducting layer 60.

The body 10 of the pressure switch is preferably composed of three elements: a lower conductive layer 40, a non-conductive central spacer 50, and an upper conducting layer 60. The upper 60 and lower 40 conducting layers could be made of many materials, but in the preferred embodiment, they will be made of a conductive polyester film such as aluminized polyester. This film might be produced in any number of ways, but in the preferred embodiment it is made by using a vacuum deposition process to place a thin layer of a conductor, such as aluminum, on one face of a polyester film. Broadly speaking, there are two preferred processes for making aluminized polyester: vacuum coating and sputtering, both of which vaporize small amounts of aluminum and redeposit same on a polyester face. Either of these approaches will yield a suitable product for use as an upper or lower conducting layer. Although aluminum is the preferred conductor, it should be clear to those skilled in the art that any conductor—including other metals, conductive ink, etc.—might be used instead. When the upper 60 and lower 40 conducting layers are brought into contact, the measured resistance across electrical leads 48 and 68 should preferably be less than about 10 ohms.

That being said, those skilled in the art will recognize that many other conductor/spacer arrangements are certainly possible. For example, two electrically-isolated conductive networks of conductive material might be imprinted on, by way of example, the lower conductive surface 40 after the manner taught in U.S. Pat. No. 5,554,835. In that case, the electrical leads 48 and 68 would both be attached to the lower conductive surface 40, each lead being in electrical contact with a different electrically-isolated network of conductive material. Thus, when upper conductive layer 60 makes contact with the lower conductive unit 40, it creates an electrical short circuit between the two networks of conductive material, thereby reducing the resistance as measured across the electrical leads 48 and 68.

The three layers—lower 40, spacer 50, and, upper 60—are preferably combined into a single water-tight "sandwich" by applying adhesive to both sides of the spacer 50 and causing the outer layers to come into contact with its now-tacky surfaces. This adhesive fixes the lower 40 and upper 60 conducting units in place and prevents any lateral movement on their parts relative to the spacer 50. It is essential that the inner surfaces of the conductive layers (items 45 and 65 of FIG. 3)—i.e., the surfaces in contact with the spacer 50—be capable of conducting electricity. It is not required that the opposite surfaces be electrically conductive.

The non-conducting spacer 50 is placed between the upper 60 and lower 40 conducting layers. Spacer 50 is preferably made of a relatively compressible non-conducting material such as a closed cell polyurethane foam and acts to keep the two conducting layers separated from one another. It is also preferred that the spacer 50 be impervious to fluids. The spacer 50 will have at least one aperture 130 therein, which aperture 130 is most clearly illustrated in FIG. 3. The aperture 130 must pass completely through the spacer 50 and should be sized slightly larger than the contact surface 170 of the actuator 70, which actuator 70 is discussed hereinafter. Although the instant invention is preferably designed to work with a single aperture 130, those skilled in the art will recognize that multiple apertures 130 might be called for in some applications. Design considerations such as the surface area of the upper 60 and lower 40 conducting units, the thickness of the spacer 50, etc., will be guides to help determine the number of apertures 130 that should be placed in a particular spacer 50. Of course, the design of actuator 70 might need to be changed to conform with the number and location of the apertures 130. By way of example, the actuator 70 might be made with multiple contact surfaces 170 to match the multiple apertures 130 in the spacer 50, or it might be formed to have a single larger contact surface 170 that contacts more than one aperture 130 at one time.

Additionally, it is not essential that the spacer 50 be a continuous piece of planar material with an aperture 130 therethrough, as other arrangements are possible. For example, the single spacer 50 as pictured in FIG. 3 might be replaced by one or more strips of dielectric material, which might have been attached to one of the inner faces (45 or 65) of the conducting members 40 or 60. In that case, rather than having a single/geometrically-regular aperture 130, there would instead be an "aperture" wherever there was no dielectric material separating the conducting members 40 and 60. The perimeter of any particular aperture 130 would then be its limits as defined by the dielectric material and the sides of the device 10. This definition of an aperture 130 might prove, in practice, to be a very irregular shape, but such an aperture 130 is specifically within the scope of the inventive concept of the instant invention.

As is best illustrated in FIG. 3, the electrical wire 20 contains at least two electrically-isolated leads 48 and 68 which are in electrical contact with the inner face 45 of conductive layer 40 and the inner face 65 of conductive layer 60, respectively. The electrical wire 20 is preferably insulated throughout its length by some sort of water resistant or water proof covering of the sort that is typically found on multi-conductor electrical wire. The cutout 140 in the body 10 is provided as a means for the electrical wire 20 to be attached so as to limit the exposure of the interior of the body 10 to moisture. In more particular, in the preferred embodiment the bare electrical leads 48 and 68 of electrical wire 20 remain encased within the insulation until they are within cutout 140, at which time the leads are separated and each is routed to an opposite side of the spacer 50, thereby placing each in contact with one of the two conductive layers. After the electrical leads 48 and 68 are installed, the cutout 140 is then filled with an epoxy or other waterproof material that serves to seal the interior of the body 10 against moisture entering around the electrical wire 20.

The body 10 is preferably affixed to the upper rim 120 of the toilet bowl through the use of some sort of dry-film adhesive. For purposes of convenience to the consumer, the outer surface 42 of the lower conducting layer 40 is typically pre-treated with adhesive at the factory and then protected by a removable cover during shipping. The consumer removes the cover to expose the tacky surface which may be pressed against the toilet bowl upper rim 120 to affix it in place there.

The actuator 70 is affixed to the underside of the toilet seat 90 in a position that brings it into contact with the body 10 of the pressure sensitive switch when the seat 90 is lowered to a horizontal position. The height of the actuator 70 is such that when the empty seat 90 is lowered, the contact surface 170 of the actuator 70 just touches the upper conducting layer 62 of the pressure switch at a point that is within the perimeter of the aperture 130 in the spacer 50. In the preferred embodiment, the actuator 70 is formed in the shape of a hemisphere and made of a soft rubber or plastic material, the upper flat surface 140 of which is preferably pre-treated with an adhesive by the manufacturer for ease in installation. The actuator 70 may, of course, be made in many shapes other than a hemisphere, but an actuator 70 with a blunt contact surface 170 is less likely to pierce the upper conducting layer 60 when pressure is applied thereto. Additionally, the contact surface 170 of the actuator 70 should be smaller than aperture 130, else the effect of applying pressure through the actuator 70 against the pressure-type switch 10 will not necessarily force the upper conductive layer 60 into contact with the lower conductive layer 40. Finally, the instant inventors specifically contemplate that one or the other of the support feet 150 of the toilet seat 90 might alternatively be used as actuators. However, that would not generally be the best choice because the feet 150 are weight bearing and would tend to fatigue a pressure-type switch. Thus, in the preferred embodiment the actuator 70 is not weight bearing and, when the seat 90 is empty, it only just contacts the upper surface 62 of the instant device.

During normal operations, the patient would be seated on a horizontal toilet seat 90, thereby causing the seat 90 to deform downward and force the contact surface 170 of the actuator 70 down into the upper face 62 of the pressure switch body 10. This pressure causes the central spacer 50 to compress and the upper conductive layer 60 to move downward into and through the aperture 130 until it makes contact with the lower conductive layer 40. When the patient rises from the seat 90, the process reverses itself and the now-unburdened seat returns to its original position, drawing the actuator 70 away from the body 10 of the contact switch. With the pressure supplied by the actuator 70 removed, compressed spacer 50 expands to nearly its original thickness and the conductive upper face 62 is free move away from the conductive lower face 42, thereby breaking the electrical contact between the two members.

The status of the pressure switch 10 is sensed by the monitoring unit 80 (FIG. 1). The monitoring unit 80 is designed to continuously measure the resistance across the two electrical leads 48 and 68. When the conductive layers 40 and 60 are not in contact with each other, the resistance measured across the two leads 48 and 68 will be high, for example about 10 megaohms. On the other hand, when the two conductive layers are brought into contact through aperture 130, the resistance as will be much lower, for example in the neighborhood of about 10 ohms. Although any number of electrical monitoring units 80 might be used with the instant invention, the preferred devices are manufactured by Bed-Check and are described within U.S. Pat. Nos. 5,654,694, 5,640,145, and 5,633,627, the disclosures of which are specifically incorporated herein by reference.

When the monitoring unit 80 senses that the resistance has dropped to near zero, its internal program logic will assume that a patient is now seated on the toilet. If low resistance continues for a period of time less than about two seconds, the monitoring unit 80 will not "arm" itself, thereby "filtering" out some spurious events (e.g., where a weight is momentarily rested on the seat). Assuming, however, that the monitoring unit 80 has armed itself, the unit 80 will resume the continuous monitoring of the now-lowered resistance across the two electrical leads 48 and 68 until such time as the resistance becomes "high" again. If the "high" resistance persists longer than about one second, that occurrence is taken by the monitor 80 to mean that the patient has risen from a seated position. At that point, depending on the particular sort of monitor and its internal logic, an audible alarm might be triggered or an electronic signal sent to a remote nurse's station or other monitoring facility. In either case, it is the responsibility of the monitor 80 to notify a care-giver that the patient has left the seat 90 of the toilet 100. The exact program logic of the monitoring unit 80 might take many forms and the previous discussion illustrates only one possible variant. Additionally, it should be noted that the particular logic embodied within the monitoring unit 80 is immaterial to the functioning of the instant invention.

Those skilled in the art will recognize that the pressure sensitive switch 10 of the instant invention may be thought of as an electrical circuit that is "open" when no weight is present on the toilet seat and "closed" when the weight on the seat is sufficient to cause the actuator 70 to compress the pressure sensitive switch 10 to the point where its internal electrical circuit becomes "closed".

Finally, in broadest terms the instant inventor has described how a binary switch/actuator combination might be used to sense the presence of an individual on a toilet seat. For purposes of the instant invention, a binary switch is one that is capable of sensing at least two conditions and responding to same via distinct electronic signals. Although a pressure sensitive switch is the binary switch of choice for use in the preferred embodiment, other types of switches could work as well. For example, reed switches, proximity sensors involving magnets, etc., could all be configured by one skilled in the art to signal the presence of an individual on a toilet seat. Of course, the actuator might need to be modified in a manner well know to those skilled in the art to reflect needs of the particular binary switch that is used.

While the inventive device has been described and illustrated herein by reference to certain preferred embodiments in relation to the drawings attached hereto, various changes and further modifications, apart from those shown or suggested herein, may be made therein by those skilled in the art, without departing from the spirit of the inventive concept, the scope of which is to be determined by the following claims.

What is claimed is:

1. A pressure sensitive switch for monitoring a patient on a toilet seat, comprising:

(a) an upper and a lower conductive member;

(b) a central non-conductive spacer, said central non-conductive spacer (b1) being positioned between said upper and said lower conductive members, and (b2) having at least one aperture therethrough, each of said at least one apertures having a perimeter;

(c) an actuator, said actuator (c1) being positioned so as to contact said upper conductive member within said perimeter of at least one of said at least one apertures when a patient is seated on the toilet seat, and, (c2) urging said upper and lower conductive members into electrical contact when the patient is seated on the toilet seat;

(d) a first electrical lead in electrical contact with said upper conductive member; and, (e) a second electrical lead in electrical contact with said lower conductive member, said first and second electrical leads for connecting to a monitor device.

2. A device according to claim 1, wherein said actuator is a toilet seat support foot.

3. A device according to claim 1, wherein the toilet seat has a lower surface and wherein said actuator is affixed to the lower surface of the toilet seat.

4. A device according to claim 1, wherein said upper and said lower conducting member are made of aluminized polyester film.

5. A toilet seat sensor for responding to the presence of a weight such as a person on a toilet seat, comprising:

(a) a first conducting member;

(b) a second conducting member;

(c) a non-conducting member separating said first and second conducting members;

(d) a first electrical lead in electrical contact with said first conducting member;

(e) a second electrical lead in electrical contact with said second conducting member; and, (f) an actuator, said actuator responding to the presence of the weight upon the toilet seat by causing said first conducting member and said second conducting member to come into electrical contact.

6. A toilet seat sensor according to claim 5, further comprising:

(g) an electronic monitoring device in electrical communication with said first and second electrical leads, said monitoring device sensing a resistance across said first and said second electrical leads and being responsive to said resistance.

7. A toilet seat sensor according to claim 5, wherein said first and second conducting members are aluminized polyester film.

8. A device according to claim 5, wherein said actuator is a toilet seat support foot.

9. A device according to claim 5, wherein the toilet seat has a lower surface and wherein said actuator is affixed to the lower surface of the toilet seat.

10. A monitoring system for determining the presence or absence of a person seated on a toilet seat, comprising:

(a) a pressure sensitive switch containing an electrical circuit, said electrical circuit being characterized by at least an electrically open state and an electrically closed state, said electrically open state occurring when the person is not seated on the toilet seat, and, second electrically closed state occurring when the person is seated on the toilet seat;

(b) an actuator, said actuator being urged against said pressure sensitive switch by a weight of the person on the toilet seat, thereby causing said electrical circuit to become electrically closed;

(c) an electronic monitoring device in electrical contact with said electrical circuit, said monitoring device being responsive at least to said electrical circuit open state and said electrical circuit closed state.

11. A device according to claim 10, wherein said pressure sensitive switch comprises:

(a1) a first conducting member;

(a2) a second conducting member;

(a3) a non-conducting member separating said first and second conducting members;

(a4) a first electrical lead in electrical contact with said first conducting member;

(a5) a second electrical lead in electrical contact with said second conducting member; and, wherein said electrical monitoring device is in electrical contact with said electrical circuit through said first and second electrical leads.

12. A device according to claim 11, wherein said first and second conducting members are aluminized polyester film.

13. A device for sensing the presence or absence of a person seated on a toilet seat, comprising:

(a) a binary switch responsive to a weight of the person seated on the toilet seat, said binary switch generating a first electrical signal when the person is seated on the toilet seat, and said binary switch generating a second electrical signal when the person is not seated on the toilet seat; and, (b) an actuator, said actuator being urged toward said binary switch when the person is seated on the toilet seat, thereby causing said first electrical signal to be generated by said binary switch.

14. A device according to claim 13, further comprising:

(c) an electronic monitoring device in electrical contact with said binary switch, said monitoring device being responsive to at least said first and second electrical signals.

* * * * *